US005864995A

United States Patent [19]

Buch

[11] Patent Number: 5,864,995

[45] Date of Patent: Feb. 2, 1999

[54] STORAGE STRUCTURE IN PARTICULAR A MULTI-STORY CAR PARK

[76] Inventor: Hermann S. Buch, Merowingerstrasse 17, D-86199 Augsburg, Germany

[21] Appl. No.: 716,390

[22] PCT Filed: Mar. 16, 1995

[86] PCT No.: PCT/EP95/00980

§ 371 Date: Nov. 25, 1996

§ 102(e) Date: Nov. 25, 1996

[87] PCT Pub. No.: WO95/25212

PCT Pub. Date: Sep. 21, 1995

[30] Foreign Application Priority Data

Mar. 17, 1994 [DE] Germany ..... 44 09 109.5
Nov. 4, 1994 [DE] Germany ..... 94 17 657 U

[51] Int. Cl.[6] ..... E01F 9/00

[52] U.S. Cl. ..... 52/174; 52/30; 414/253; 414/227; 414/229

[58] Field of Search ..... 52/30–33, 174, 52/175; 414/229, 227, 239, 253, 259, 264, 486, 261, 255; 187/250

[56] References Cited

U.S. PATENT DOCUMENTS

| | | | |
|---|---|---|---|
| 3,664,523 | 5/1972 | Hagel | 414/239 |
| 3,675,378 | 7/1972 | Neuann et al. | 52/174 X |
| 5,267,822 | 12/1993 | Paravia et al. | 52/174 X |
| 5,333,987 | 8/1994 | Takaoka | 52/143 X |
| 5,467,561 | 11/1995 | Takaoka | 52/30 |
| 5,469,676 | 11/1995 | Colsman | 52/174 |
| 5,478,182 | 12/1995 | Hildebrand | 414/261 |
| 5,573,364 | 11/1996 | Schneider | 414/234 |

*Primary Examiner*—Carl D. Friedman
*Assistant Examiner*—Beth Aubrey
*Attorney, Agent, or Firm*—Richard C. Litman

[57] ABSTRACT

A storage structure including a plurality of storage spaces disposed helically about a cylindrical shaft and including a lifting vehicle which is guided in the shaft so that it winds about the vertical axis of the shaft in a screw-like manner. Provided on the lifting vehicle is at least one consumer. A stowage unit is provided on the lifting vehicle or in the region of the floor of the shaft. A supply line for connecting the consumer to a supply unit is received within the stowage unit. The stowage unit is open at the top and defines a cavity which may include a winding spindle. The cavity and the winding spindle are disposed about the vertical axis of the shaft so that the supply line can be received as the lifting vehicle rotates. The outer periphery of the cavity corresponds substantially to the pitch of the helix defining the motion of the lifting vehicle.

15 Claims, 3 Drawing Sheets

STORAGE STRUCTURE IN PARTICULAR A MULTI-STORY CAR PARK

BACKGROUND OF THE INVENTION

The object of the present invention is a storage structure, particularly a car park, with a large number of storage areas, particularly vehicle parking places, arranged helically around a cylindrical shaft, and with a lifting vehicle operated in a helical fashion in the shaft around the vertical axis, the lifting vehicle being fitted with at least one consumer, in particular an electrical consumer, which needs to be supplied.

Such a storage structure, designed as a car park, is known, for example, from the German patent publication of the unexamined application No. 1684721. In this document, the lifting vehicle is designed as a platform which takes an automobile, which is advanced by gearing onto a track which runs helically around the shaft. A vehicle, parked in a drive in box, is mechanically conveyed to the platform and is then helically raised until it is opposite an empty parking place. The automobile is mechanically parked in the parking place. Conversely, the parked automobiles can be moved in the opposite sequence from the parking places to the platform, and then by means of the platform to a drive-out box.

The platform is fitted with electric motors to drive it. Additionally, the loading device, by means of which a vehicle is conveyed on to and off the platform, also has an electromotive drive.

SUMMARY OF THE INVENTION

DE-OS 1684721, contains no description of how the electric motors fitted to the platform are to be supplied with electricity.

The object to be achieved by the present invention is to provide, in design, a generic storage facility, an economical, reliable, low-maintenance solution for the connection to a supply unit of the consumers which are to be fitted to the lifting vehicle.

In accordance with the present invention, this object is achieved, as a first alternative, by means of the characteristics of claim 1. An alternative solution to the object is indicated in claim 2.

Cavities for the laying of a supply line are known from the prior art (e.g. DE-GM 9012229 1, U.S. Pat. No. 3,300,154, FR-B-1304183, and GB-B-1213037).

The invention is described below in further detail on the basis of the first alternative solution indicated in claim 1. The advantages indicated below also apply to the second alternative solution.

The invention is obviously applicable to all kinds of supply lines. i.e. electrical, hydraulic and pneumatic lines, as well as water and gas lines, and also to data transmission and other control lines. Wherever references are made below to electrical supply lines, this indicates an illustrative application which does not restrict the invention.

The invention is such as to avoid the use of sliding contacts, which are otherwise normally used—for example, in the case of parts which are electrically connected to each other and rotate around each other. Rather, the supply line is designed so that it is firmly connected to the lifting vehicle at one end, and to the structure at the other end. This ensures that, in the case of an electrical supply line, supply achieves a high degree of reliability not possible in the case of rubbing contacts. By designing the open-top cavity that accommodates the supply line so that its external circumference basically corresponds to the pitch of the helix for the lifting vehicle, it is possible to achieve a completely twist-free laying of the supply line. In this way, the supply line attains a practically unlimited lifespan. The minimal stress on the supply line is also reflected in increased supply reliability. Because the cavity in which the supply line is laid is arranged around the vertical axis of the shaft, it is possible for the supply line to move freely without rubbing against the walls of the cavity. This also contributes to the mechanical protection of the supply line and to an increase in its lifespan.

Assuming that the external circumference of the cavity in which the supply line is to be stowed should "largely" correspond to the pitch of the helix for the lifting vehicle, it may be deduced that—depending on the diameter of the supply line—the external circumference of the cavity may and indeed should be somewhat greater than the pitch. This is optional when the central, neutral wire of the supply line is laid along a circle whose circumference corresponds to the pitch in the helix in addition to the diameter of the supply line. Only if the diameter of the supply line is negligible relative to the pitch of the helix is the design optimum, meaning that the external diameter of the cavity corresponds exactly to the pitch of the helix.

In cavities per se, the supply line is fed in a translational fashion, so that there is forced twisting of the accommodated supply line, and the resultant mechanical strain on the supply line may considerably shorten its lifespan. Totally twist-free laying of the supply line can only be achieved by the combination, taught by the present invention, of the cavity for stowing a supply line and the helical motion of the other end, the circumference of the circular cavity being matched to the pitch of the screw motion of the lifting vehicle.

The cavity for stowing the supply line in an annular shape is particularly preferred. For this purpose, a central guide body and the wall demarcating the cavity from the outside is expediently designed to be slightly greater than the diameter of the supply line. A particularly useful feature is the cylindrical design of the annular cavity in coaxial arrangement relative to the vertical axis of the shaft. This reduces to a minimum the danger that the supply line will rub against the walls of the annular cavity.

In the first alternative solution recited in claim 1, the cavity is advantageously arranged below the level of the shaft floor. Even extremely long supply lines, such as are required in the case of a multi-floor parking garage, can in this way be placed in the stowing unit when the lifting vehicle is lowered without taking up valuable room below the lifting vehicle. Instead, where the storage facility is designed accordingly, the lifting vehicle can be lowered right down to the shaft floor.

The end of the supply line, which is attached to the lifting vehicle as per claim 1, is usefully eccentrically fixed thereto at a distance from the vertical axis which essentially corresponds to the radius of the supply line stowing cavity. In this way, without using additional guiding devices, it is possible to ensure that the supply line is stowed in and removed from the stowing unit in a particularly careful fashion.

The alternative indicated in claim 2 of the invention is to be preferred to the alternative according to claim 1 if the rotating speed of the lifting vehicle exceeds a certain value. If, when the stowing unit is arranged in the area of the shaft floor, supply line suspended from the lifting vehicle is subject to a centrifugal force when the lifting vehicle is rotating, which can hanger the orderly stowing or accommodation of the supply line, when the stowing unit is arranged on the lifting vehicle for a supply line suspended from the roof of the structure, no centrifugal forces act on its freely suspended section. Additionally, the centrifugal forces that act on the supply line section accommodated in the stowing unit are absorbed by the external wall of the stowing unit.

Even though the stowing unit design is particularly advantageous insofar as it comprises a cavity open at the top in which the supply line is stowed, as it thereby guarantees smooth stowage and accommodation of the supply line under all marginal conditions, under the invention it is also possible for the stowing unit to have a single spindle which ends freely at the top, around which the supply line is stowed. This alternative, indicated in claims 9 and 10, may be applied, for example, if only a few turns of the feed line must be accommodated in the stowing unit. The optimum external diameter DD of the spindle can be calculated by applying the relationships indicated above relative to the pitch (s) of the helix and the diameter (d) of the supply line as $D_D=(s+d)/\pi-d$.

The invention is explained below in greater detail on the basis of the diagrams.

DETAILED DESCRIPTION OF THE PREFERRED EMBODIMENTS

Figure 1:
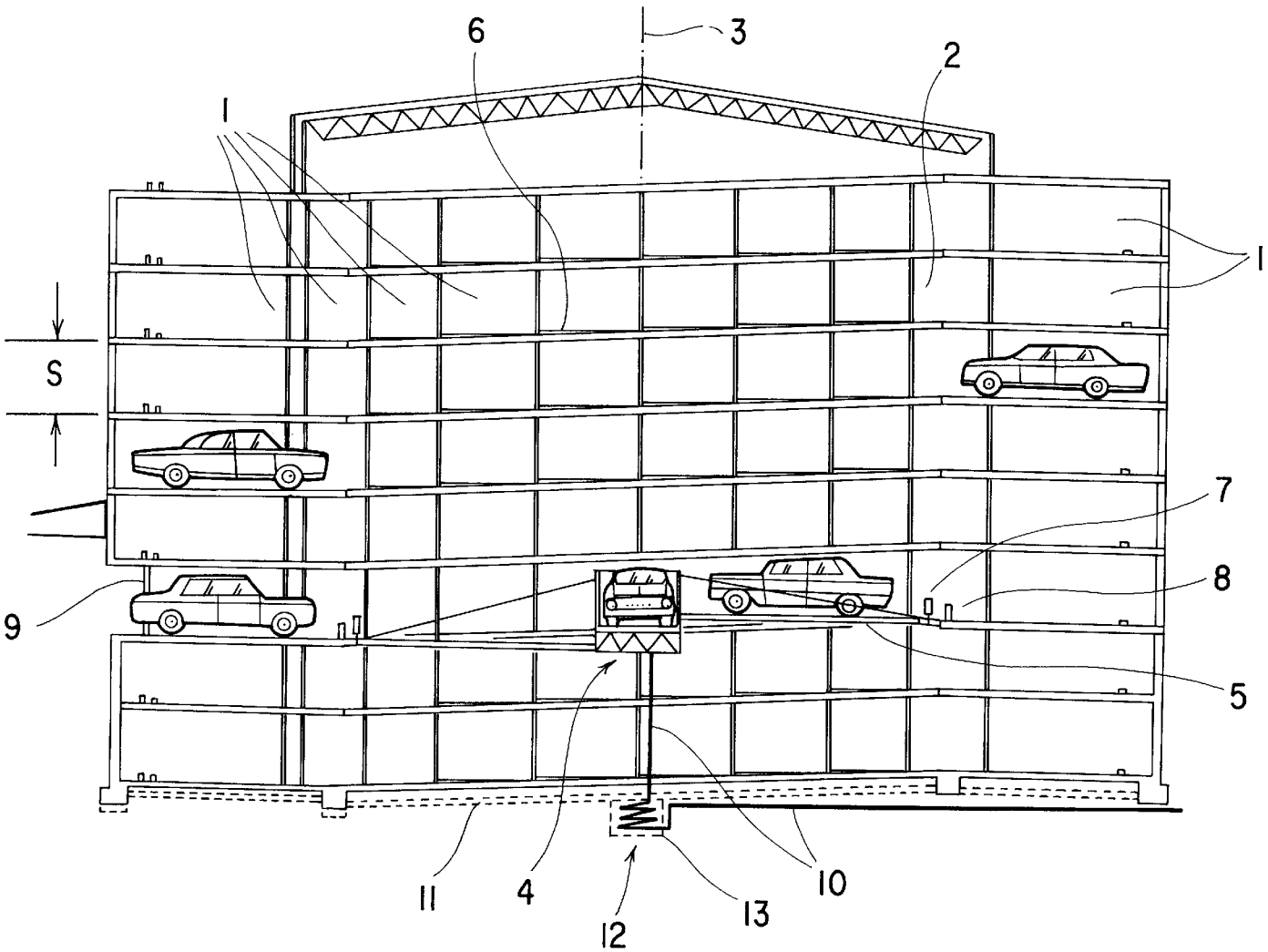
FIG. 1 shows a vertical section through the first embodiment of a storage structure according to the invention, designed as a car park.
Figure 2:
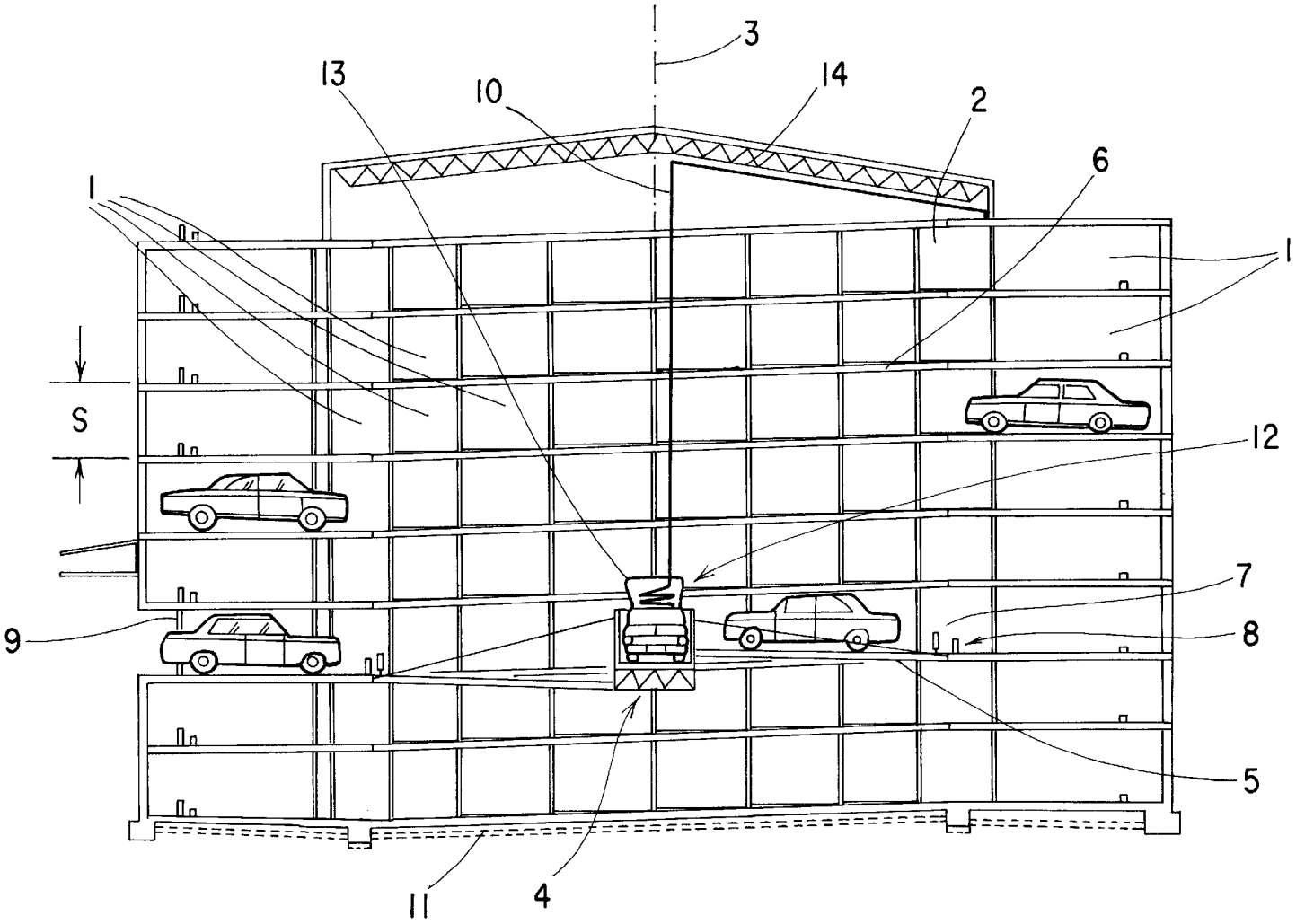
FIG. 2 shows a vertical section through a second, alternative embodiment of a storage structure according to the invention, designed as a car park, FIG. 3 explains the dimensioning of the stowing unit for the supply line, used for the car park according to FIGS. 1 and 2.

The structure of the car park shown in FIGS. 1 and 2 contains a large number of automobile parking places 1 arranged helically around a central cylindrical shaft 2 with the vertical axis 3. Shaft 2 accommodates a lifting vehicle 4. The ends of the four platforms 5 of this lifting vehicle are supported on a helical guide 6, which runs along the drive-in openings of the automobile parking places 1. At the end of each platform 5 is a drive unit 8 comprising an electric motor 7. By means of these drive units, the lifting vehicle 4 can be rotated around the vertical axis 3, thereby performing a helical upward or downward movement corresponding to the helical course of the guide 6. In this fashion, each of the platforms 5 can be placed opposite each of the automobile parking places 1 and also opposite the drive-in box, as well as a drive-out box (not shown).

By the present invention, the supply line 10 supplies the electric motors 7 with electrical power and also controls them. One end of the supply line is fixed to the bottom of the lifting vehicle 4. The supply line 10 leads to a supply and control unit (not shown). Underneath the shaft floor 11, a stowing unit 12 is fitted to take the supply line 10. This unit includes a cup-shaped receptacle 13 for the supply line 10 arranged coaxially with the parking garage vertical axis 3.

The supply line 10 coming from the supply and control unit is guided from underneath into the cup-shaped receptacle 13. The dimensions of the receptacle are such that it can accommodate the entire length of the supply line extending from the lifting vehicle 4 when the latter is completely lowered. The length of the supply line suspended from the lifting vehicle can be calculated relative to the total height of the car park; the length of the supply line between the lifting vehicle and entry into receptacle 13 must be sufficient to allow the lifting vehicle to be placed in its top position without the supply line being taught.

Determining the dimensions of receptacle 13 is described in greater detail below in conjunction with FIG. 3. Essentially, this involves the circumference of the supply line loops stowed in the receptacle 13 corresponding to the pitch s of the helical guide 6. The supply line 10 is fixed eccentrically to the lifting vehicle. The distance between the supply line fixing point on the lifting vehicle and the vertical axis 3 corresponds to the radius of the loops accommodated in the receptacle 13.

The difference between the alternative shown in FIG. 2 and that in FIG. 1 is that the cup-shaped receptacle 13 for the supply line 10 is arranged in the center of the lifting vehicle 4 and not underneath the floor 11 of the shaft 2. The supply line 10 is thus fed from roof 14 of the car park. Here, too, the supply line is fixed off-center; the distance between the supply line fixing point and the vertical axis 3 corresponds to the radius of the supply line loops accommodated in the receptacle 13.

The upper edge of the receptacle 13 fans out in a tulip shape. This reliably and carefully "catches" the supply line 10 hanging down from the roof 14, even if the line should describe oscillating motions.

Figure 3:
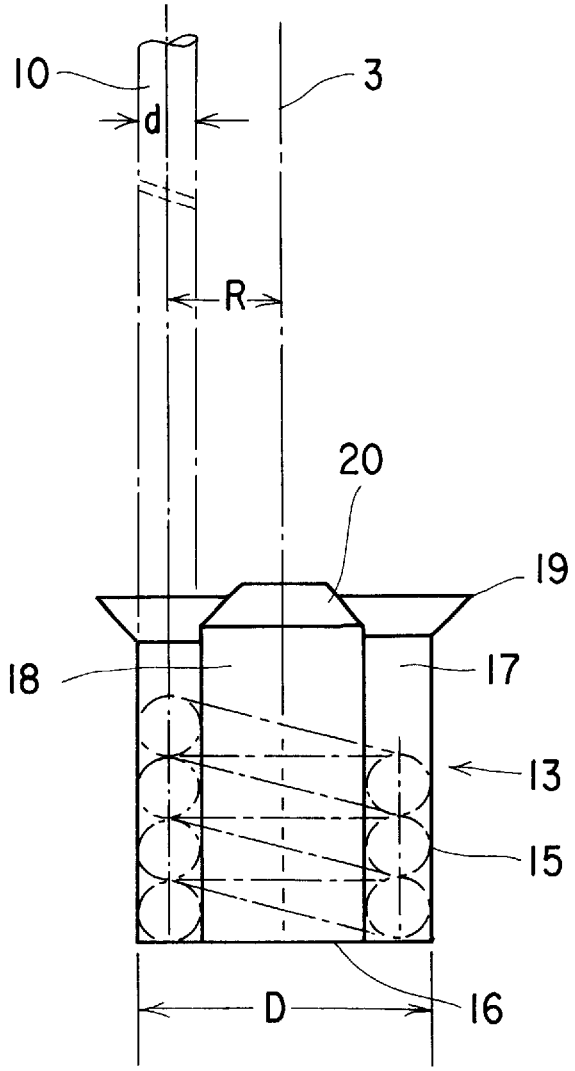

FIG. 3 indicates the optimum dimensioning of the receptacle 13 for the supply line 10 which is to be stowed. In order to show the relationships, the diameter d of supply line 10 has been exaggerated.

The receptacle 13 has a cylindrical external wall 15 and a floor 16. The external wall 15 demarcates the outer limits of cavity 17 which accommodates the supply line 10. The cavity 17 has an annular design; for this purpose a central cylindrical guide 18 is fitted in a coaxial arrangement to the axis 3. The gap left between this and the external wall 15 is slightly greater than the diameter d of the supply line 10.

While the external wall 15 of the receptacle 13 fans out in a tulip shape at its upper end 19, the upper end 20 of the guide 18 is conically tapered. This provides an opening for the supply line 10.

The diameter D of the cylindrical external wall 15 of receptacle 13 is the result of the pitch s (FIG. 1) of the helical guide 6 (FIG. 1) and the diameter d of the supply line 10 according to the following formula $D=(s+d)/\pi+d$. The distance R, at which the corresponding end of the supply line 10 is fixed to the roof 14 of the parking garage (FIG. 2) or to the lifting vehicle 4 (FIG. 1), from the vertical axis 3 is therefore determined according to the following rule: $R=(s+d)/2\pi$.

I claim:

1. A storage structure comprising:

a plurality of storage areas arranged helically to define a cylindrical shaft having a vertical axis;

a lifting vehicle operating in a helical motion having a pitch (s) within the cylindrical shaft, said lifting vehicle having at least one consumer;

a supply line fixed at one end to said lifting vehicle, said supply line having a diameter (d), said supply line for connecting said at least one consumer to a supply unit; and a stowage unit disposed substantially about said vertical axis below said lifting vehicle, said stowage unit having an open top and a cavity for receiving said supply line, said stowage unit having an external circumference substantially corresponding to the pitch (s) of the helical motion of the lifting vehicle.

2. The storage structure according to claim 1 wherein the cavity is cylindrical and is arranged coaxially with respect to the vertical axis of the cylindrical shaft.

3. The storage structure according to claim 1 wherein said stowage unit includes a central guide whereby the cavity has an annular design.

4. The storage compartment according to claim 3 wherein said central guide has an external diameter ($D_D$) determined by the rule $D_D=(s+d)/\pi-d$.

5. The storage structure according to claim 1 wherein said supply line is fixed eccentrically to said lifting vehicle.

6. The storage structure according to claim 5 wherein said supply line is fixed to said lifting vehicle at a point that is a distance (R) from the vertical axis, the distance (R) determined by the rule $R=(s+d)/2\pi$.

7. The storage structure according to claim 1 further comprising a floor below the cylindrical shaft, said stowage unit extending beneath said floor.

8. The storage structure according to claim 1 wherein said stowage unit includes an cylindrical external wall having a diameter (D) determined by the rule $D=(s+d)/\pi+d$.

9. A storage structure comprising:

a plurality of storage areas arranged helically to define a cylindrical shaft having a vertical axis;

a roof above said cylindrical shaft;

a lifting vehicle operating in a helical motion having a pitch (s) within the cylindrical shaft, said lifting vehicle having at least one consumer;

a supply line fixed at one end to said roof, said supply line having a diameter (d), said supply line for connecting said at least one consumer to a supply unit; and a stowage unit disposed substantially about said vertical axis on said lifting vehicle, said stowage unit having an open top and a cavity for receiving said supply line, said stowage unit having an external circumference substantially corresponding to the pitch distance (s) of the helical motion of said lifting vehicle.

10. The storage structure according to claim 9 wherein the cavity is cylindrical and is arranged coaxially with respect to the vertical axis of the cylindrical shaft.

11. The storage structure according to claim 9 wherein said stowage unit includes a central guide whereby the cavity has an annular design.

12. The storage compartment according to claim 11 wherein said central guide has an external diameter ($D_D$) determined by the rule $D_D=(s+d)/\pi-d$.

13. The storage structure according to claim 9 wherein said supply line is fixed eccentrically to said roof.

14. The storage structure according to claim 13 wherein said supply line is fixed to said roof at a point that is a distance (R) from the vertical axis, the distance (R) determined by the rule $R=(s+d)/2\pi$.

15. The storage structure according to claim 9 wherein said stowage unit includes an cylindrical external wall having a diameter (D) determined by the rule $D=(s+d)/\pi+d$.

* * * * *